United States Patent [19]

Liaw

[11] Patent Number: 4,955,546

[45] Date of Patent: Sep. 11, 1990

[54] WATER JET GUN

[76] Inventor: Maw-Shinn Liaw, 69-2, Sec. 2, Chien-Kuo Rd., Min-Hsiung Hsiang, Chia-yi Hsien, Taiwan

[21] Appl. No.: 389,573

[22] Filed: Aug. 4, 1989

[51] Int. Cl.[5] ..... B05B 1/30

[52] U.S. Cl. ..... 239/440; 239/441; 239/448; 239/449; 239/526; 239/581.1

[58] Field of Search ..... 239/447, 449, 441, 440, 239/439, 438, 436, 437, 525, 526, 581.1, 582.1

[56] References Cited

U.S. PATENT DOCUMENTS

| | | | |
|---|---|---|---|
| 2,313,994 | 3/1943 | Grant | 239/440 |
| 2,333,767 | 11/1943 | Davis | 239/449 |
| 2,892,306 | 6/1959 | Intintolo | 239/581.1 |
| 3,093,318 | 6/1963 | Chow | 239/526 |
| 3,529,774 | 9/1970 | Apri | 239/581.1 |
| 4,534,512 | 8/1985 | Chow et al. | 239/526 |
| 4,618,100 | 10/1986 | White et al. | 239/440 |
| 4,785,998 | 11/1988 | Takagi | 239/440 |

FOREIGN PATENT DOCUMENTS

| | | | |
|---|---|---|---|
| 3007290 | 9/1981 | Fed. Rep. of Germany | 239/441 |
| 180911 | 4/1936 | Switzerland | 239/449 |

*Primary Examiner*—Kevin P. Shaver
*Assistant Examiner*—Christopher G. Trainor
*Attorney, Agent, or Firm*—Barnes & Thornburg

[57] ABSTRACT

A water jet gun includes a gun-like body which has a handle portion and a transverse tubular housing portion enclosing a hollow plug. The tubular housing is provided with a first opening communicated with the handle portion and the hollow plug has a second opening to communicate with the first opening to form a flow passage. The second opening is tapered from one end thereof to another opposite end in the circumferential direction of the hollow plug so that the dimension of the flow passage is variable upon the rotation of said hollow plug. The hollow plug is further provided with a spout which provides water jets of different patterns.

3 Claims, 6 Drawing Sheets

WATER JET GUN

BACKGROUND OF THE INVENTION

This invention relates to a water jet gun and particularly to a water jet gun having a hollow plug which is operable to rotate in a tubular housing and which has a tapered opening in the wall thereof to communicate adjustably with another opening in the wall of the tubular housing so as to create different flow passages.

An object of the invention is to provide a water jet gun with a simple construction which creates jets of water with different adjustable flow rates so that the gun can be used for various washing processes.

Another object of the invention is to provide a water jet gun with an improved spout which creates water jets of different patterns.

SUMMARY OF THE INVENTION

According to the present invention, a water jet gun comprises, a gun-like body having a handle portion with an inlet end and a tubular housing portion transverse to the handle portion, the tubular housing portion having a front end, a rear end, and a tubular wall with a first opening which is communicated with the interior of the handle portion; a hollow plug movably received in the tubular housing portion and having a front outlet end which extends out of the front end of the tubular housing portion, a rear end which extends out of the rear end of the tubular housing portion, and a tubular wall which is in contact with the tubular wall of the tubular housing portion and which has a second opening, the hollow plug being operable to rotate relative to the tubular housing portion between a first position in which the first and second openings communicate with one another to form a flow passage and a second position in which the first and second openings do not intercommunicate, the second opening being tapered in the annular direction of the hollow plug from one end of the second opening to another opposite end thereof so that the dimension of the flow passage is variable upon rotation of the hollow plug, a spout connected to the front outlet end of the hollow plug; and a sealing means provided around the hollow plug.

In one aspect of the invention, the spout comprises a spout housing having a first enlarged front hollow portion which has a foremost second enlarged hollow portion broader than the remaining portion of the first enlarged hollow portion, the first enlarged hollow portion having an outer periphery which is provided with a first screw thread, the second enlarged hollow portion having an inner periphery provided with a plurality of grooves, the spout further having a restricted rear hollow portion which is connected to the front outlet end of the hollow plug, the restricted hollow portion having a nozzle member extending therefrom into the first enlarged hollow portion, the nozzle member having a tube wall provided with a plurality of annularly spaced peripheral openings and a front outlet end, a hollow head movably provided in the first enlarged hollow portion, having an outer annular wall, an inner annular wall within the outer annular wall, a perforated cover plate which is connected to the front ends of the outer and inner annular wall and which has a central first opening and a plurality of second openings around the first opening, and a first annular flange which projects forwardly and flares outwardly from the front end of the outer annular wall and extends outwardly of the first enlarged hollow portion, the first annular flange having a plurality of third openings formed around the perforated cover plate.

The first enlarged hollow portion, the perforated plate, the annular outer wall and the annular inner wall cooperatively confine a pressure chamber anterior to the restricted hollow portion of the spout housing. The front outlet end of the nozzle member extends into the inner annular wall passing through the pressure chamber. A first sealing ring is provided between the inner annular wall of the head and the nozzle member. A second sealing ring is provided around the outer annular wall of the head. An adjustment ring member is provided around the first enlarged hollow portion and has a second screw thread to engage with the first screw thread, the adjustment ring member being cooperatively associated with the first annular flange and capable of moving the head relative to the spout housing when the adjustment ring member is turned relative to the spout housing.

The position of the second sealing ring is changeable between a first position in which the second sealing ring is in the space between the second enlarged hollow portion and the outer annular wall, permitting fluid communication between the space and the pressure chamber, and a second position in which the second sealing ring is in between the first enlarged hollow portion and the outer annular wall, sealing off the fluid communication between the space and the pressure chamber.

The position of the inner annular wall relative to the nozzle member is changeable between a third position in which the first sealing ring of the inner annular wall is anterior to the peripheral openings of the nozzle member, sealing off the fluid communication between the peripheral openings and the inner annular wall and a fourth position in which the inner annular wall surrounds the peripheral openings.

The present examplary preferred embodiment will be described in detail with reference to the accompanying drawings, in which:

DETAILED DESCRIPTION OF THE PREFERRED EMBODIMENT

Figure 3:
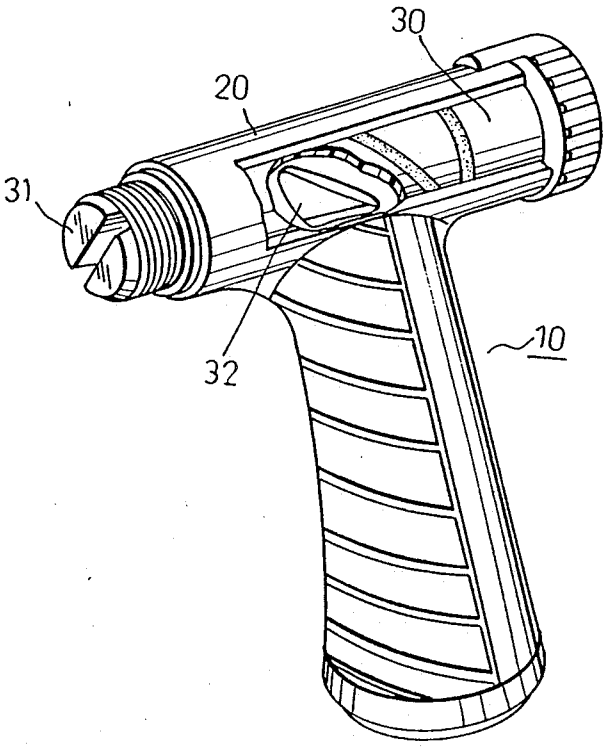
FIG. 3 is a perspective view of the water-jet gun of FIG. 2.
Figure 1:
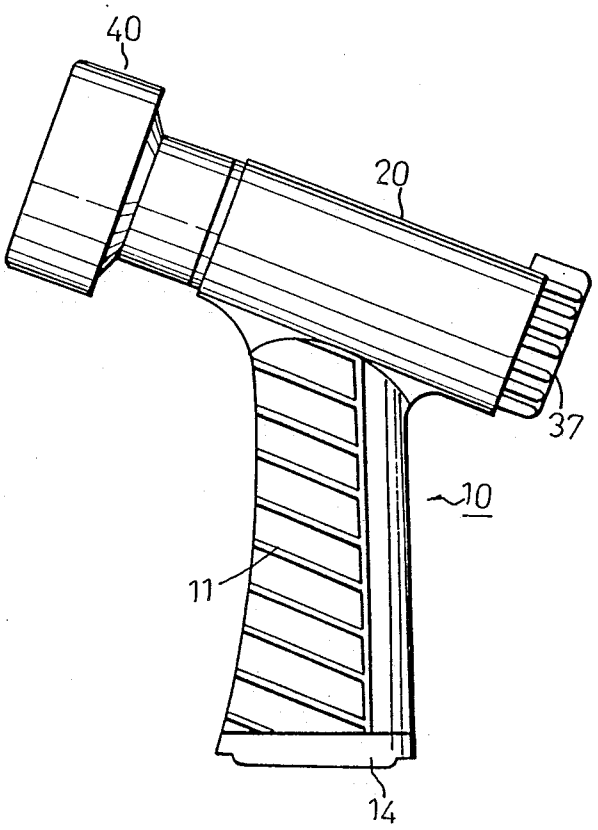
FIG. 1 is an elevation view of a water jet gun embodying the present invention.
Figure 2:
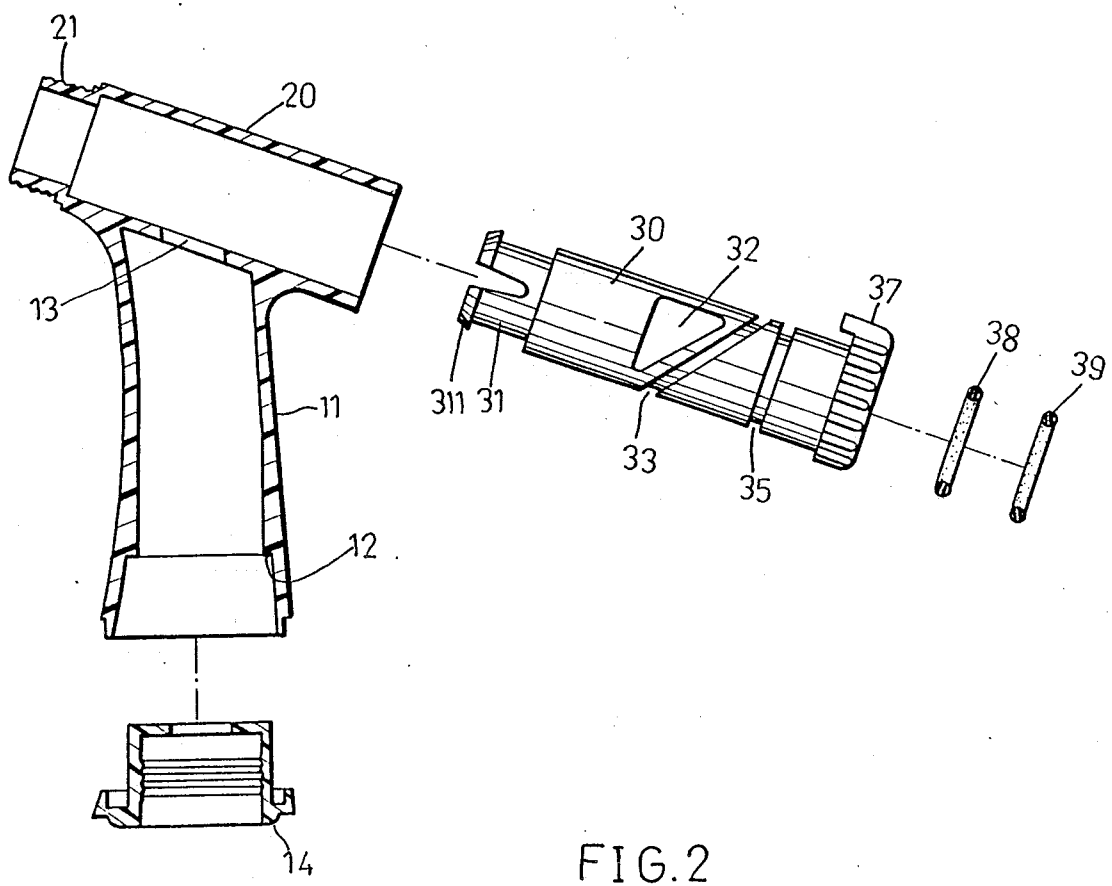
FIG. 2 is an exploded view of the water jet gun of FIG. 1 with the spout thereof being removed.

Referring to FIGS. 1, 2 and 3, a water jet gun according to the invention is shown, having a one-piece molded gun-like body with a handle portion 10 and a tubular housing body 20. A spout 40 is attached to a front of the tubular housing body 20. The handle portion 10 is provided with a shoulder 12 at one open end thereof, and a connector 14 is connected to the open end of the handle portion 10 and engaged with the shoulder 12. The other end of the handle portion 10 is integrally connected to the periphery of the tubular housing body 20 and is communicated with an axially elongated opening 13 provided in the periphery of the tubular housing body 20. The tubular housing body 20 is provided with a screw thread 21 at the front end thereof which engages with the spout 4.

Figure 4D:
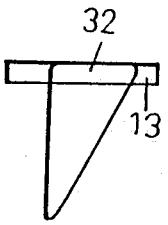
FIGS. 4A to 4D show varying cross-sections of the flow passages formed by the communication between the openings of the hollow plug and the tubular housing of the gun of FIG. 1.
Figure 4C:
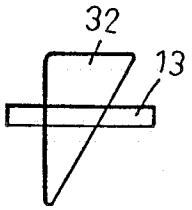
Figure 4B:
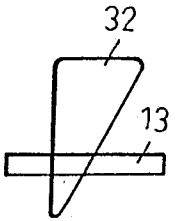
Figure 4A:
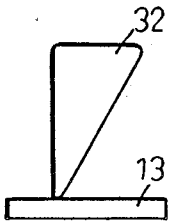

The housing body 20 receives a hollow plug 30 which includes a front split end 31 with a split 31 communicated with the interior of the hollow plug 30 and a manually operable rear knob 37. The split end 31 extends through the front end 21 of the tubular housing body 20 and engages with the front end 21 with its annular flange 311. A sealing ring 38 is fitted in a peripheral groove 33 of the hollow plug 30, extending along an intersecting line of the periphery of the tubular housing body 20 and a plane which inclines with respect to the longitudinal axis of the hollow plug 30. Another sealing ring 39 is provided in an annular groove 35 provided in the periphery of the hollow plug 30. A substantially triangular opening 32 is provided in the periphery of the hollow plug 30 to communicate with the elongated opening 13 of the tubular housing body 20. The position of the triangular opening 32 can be changed by rotating the plug 30 so that the dimension of the passage formed by the communication between the openings 13, 32 can be adjusted. The different positions of the triangular opening 32 relative to the opening 13 during the rotation of the plug 30 are shown in FIGS. 4A to 4D. In FIG. 4A, the triangular opening 32 does not communicates with the opening 13 and therefore water cannot be jetted through the gun. The largest water passage is created when the openings 32 and 13 are in the position shown in FIG. 4D.

Figure 5:
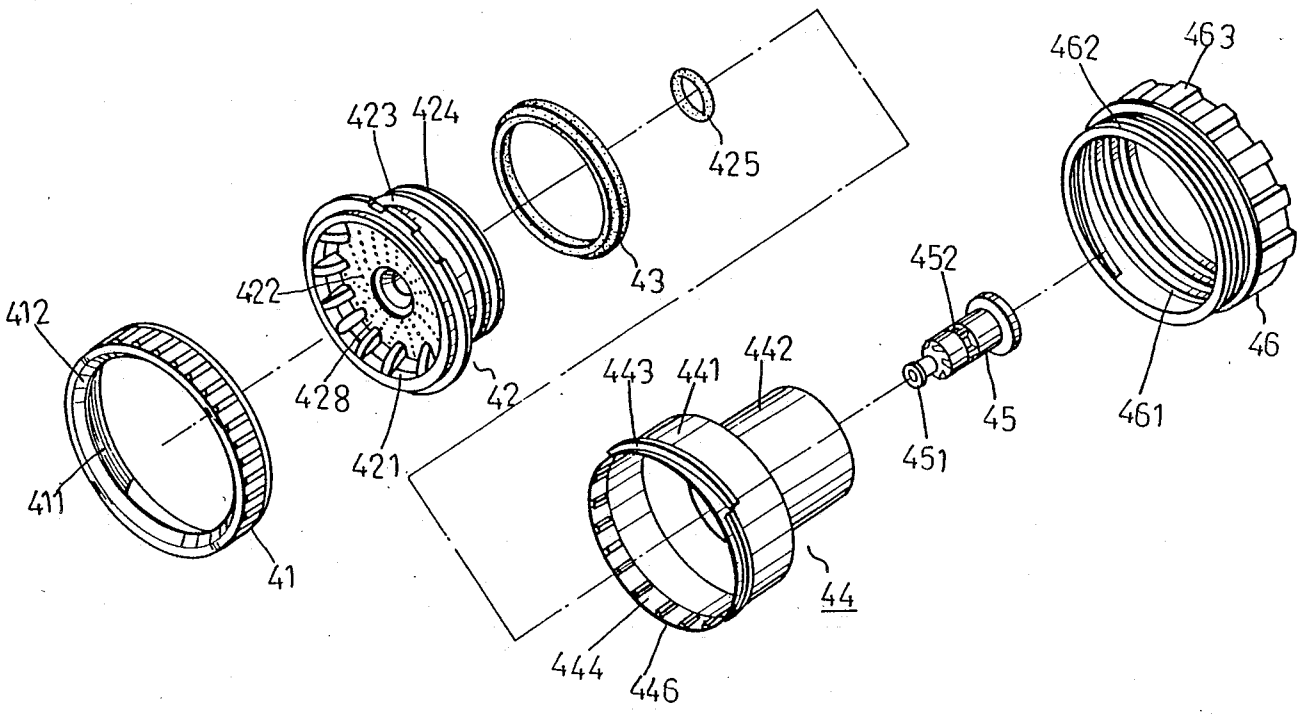
FIG. 5 is an exploded view of the spout of the gun of FIG. 1.
Figure 6:
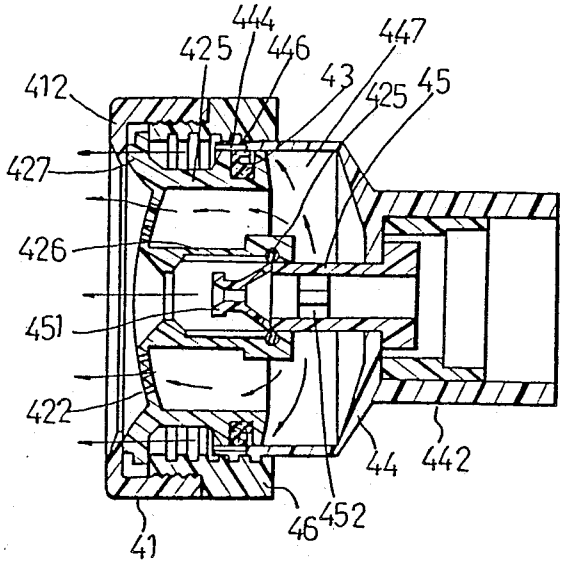

Referring to FIGS. 5 and 6 in combination with FIG. 3, the spout 40 includes a spout housing 44 which encloses a head member 42. The spout housing 44 has an enlarged hollow portion 441 which receives the head member 42 and a restricted hollow portion 442 threadedly connected to the front end of the tubular housing body 20 and communicated with the split end 31 of the hollow plug 30.

On the outer periphery of the enlarged hollow portion 441 are provided segments of helical threads 443 which engage with an inner screw thread 461 of an annular adjustment member 46 provided around the enlarged hollow portion 441. A plurality of axial grooves 444 are provided in the inner periphery of a slightly enlarged front part 446 of the enlarged hollow portion 441. A head 42 is provided in the enlarged hollow portion 441 of the spout housing 44. The head 42 includes an outer annular wall 425 and an inner annular wall 426. On the outer annular wall 426 are provided two spaced apart annular flanges 423, 424 which define an annular groove receiving a sealing ring 43. The distal ends of the flanges 423, 424 slideably contact the inner surface of the enlarged hollow portion 441 and the sealing ring 43 provides a fluid seal between the inner surface of the hollow portion 441 and the rear portion of the head 42. A front perforated plate 428 is connected to the front ends of the outer and inner annular walls 425, 426. A front annular flange 427 flares outward and forward from the front end of the outer annular wall 425 and then extends radially outward. Slots 421 are provided in the annular flange 427 forming additional outlet openings of the head 42.

The enlarged hollow portion 441, the perforated plate 428, the outer annular wall 425 and the inner annular wall 426 confine a pressure chamber 447 anterior to the restricted hollow portion 442. A nozzle member 45 is fitted in the restricted hollow portion 442 and extends therefrom into the inner annular wall 426 passing through the pressure chamber 447 of the enlarged hollow portion 441. The nozzle member 45 has a front outlet end 451 and a plurality of peripheral openings 452. A sealing ring 425 is provided between the inner annular wall 426 and the nozzle member 45 and is positioned in an annular groove of the inner annular wall 426.

An adjustment ring member 46 is provided around the enlarged hollow portion 441 of the spout housing 44 and has a screw thread 461 to engage with the screw segments 443 of the spout housing 44. An external screw thread 462 engages with the internal screw thread 411 of an annular guide member 41. A front flange 412 of the guide member 41 engages with the flange 427 of the head 42. The adjustment member 46 is further provided with axial ridges 463 which provides a nonslip surface to facilitate, for the user, the manipulation of the adjustment member 46.

In operation, the water flowing out from the hollow plug 30 advances to the restricted hollow portion 442 of the spout housing 44 and then to the nozzle member 45. The adjustment ring member 46 can be operated to move rearward or forward relative to the spout housing 44. When the adjustment ring member 46 is turned, the guide member 41 as well as the head 42 are moved in turn. The positions of the sealing rings 43, 425 are changed, when the head 42 is moved.

FIG. 6 shows that the head 42 is in a foremost first position in which the sealing ring 43 is in a space between the slightly enlarged front portion 446 of the spout housing 44 and the outer annular wall 425. In this situation, the sealing ring 43 does not seal off the grooves 444 of the slightly enlarged portion 446 from the pressure chamber 447. However, the sealing ring 425 interrupts the communication between the pressure chamber 447 and the interior of the inner annular wall 426. Therefore, water is forced out from the peripheral openings 452 of the nozzle 45, passes through the pressure chamber 447, and finally emitted from the slots 421 formed in the flange 427 and the openings 422 of the perforated plate 428 of the head 42.

Figure 7:
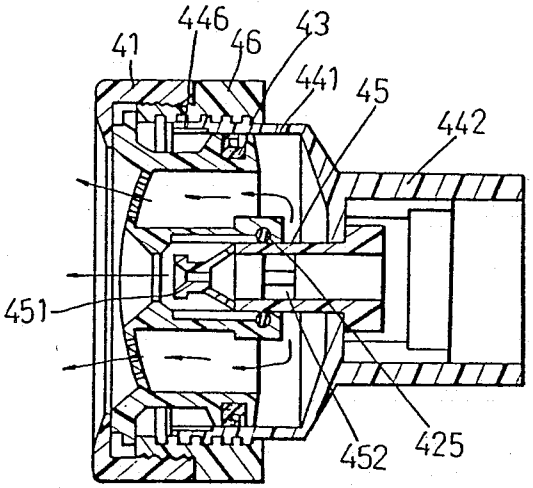
FIGS. 6 to 9 are sectional views showing the operations of the spout of the gun.

When the head 42 is moved rearward to a second position as shown in FIG. 7, the sealing ring 43 is at a location behind the grooves 444, sealing off the communication between the grooves 444 and the pressure chamber 447. The sealing ring 425 still seals off the communication between the peripheral openings 452 of the nozzle member 45 and the interior of the annular wall 426. Therefore, water is emitted through the openings of the perforated plate 428.

Figure 8:
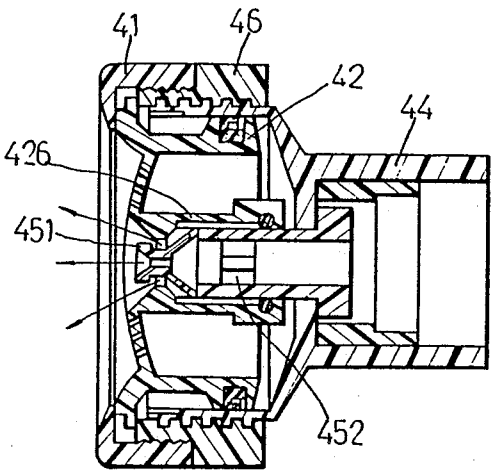

When the head 42 is moved further rearward to a third position as shown in FIG. 8, the inner annular wall 426 is in turn moved rearward so that the inner annular wall 426 surrounds the peripheral opening 452 of the nozzle member 45. Since the sealing ring 425 seals off the communication between the chamber 447 and the interior of the inner annular wall 426, water is forced out through the central opening of the perforated plate 427 and through the space between the nozzle member 45 and the inner annular wall 426 from both the front outlet end 451 and the peripheral openings 452 of the nozzle member 45.

Figure 9:
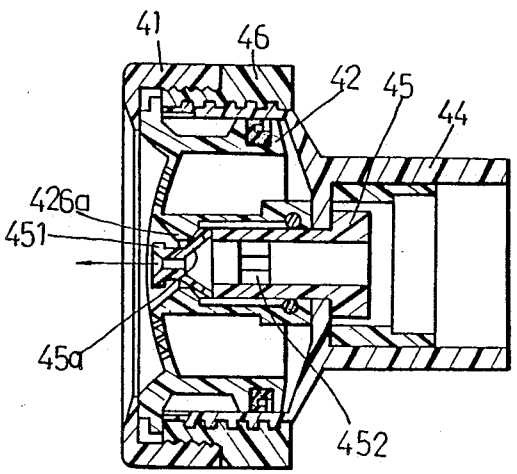

When the head 42 is moved further rearward, the neck portion 426*a* of the inner annular wall 426 abuts with the truncated-cone shape portion 45*a* of the nozzle member 45, thereby preventing water which is flowing out of the peripheral openings 452 of the nozzle from escaping through the central opening of the perforated plate 427, as shown in FIG. 9. Therefore, water is emitted only through the front outlet end 451 of the nozzle 45.

With the invention thus explained, it is apparent that various modifications and variations can be made without departing from the scope of the invention. It is therefore intended that the invention be limited as indicated in the appended claims.

What I claim is:

1. A water jet gun comprising:

a gun-like body having a handle portion with an inlet end and a tubular housing portion transverse to said handle portion, said tubular housing portion having a front end, a rear end, and a tubular wall with a first opening which is communicated with the interior of said handle portion;

a hollow plug movably received in said tubular housing portion and having a front outlet end which extends out of said front end of said tubular housing portion, a rear end which extends out of said rear end of said tubular housing portion, and a tubular wall which is in contact with said tubular wall of said tubular housing portion and which has a second opening, said hollow plug being operable to rotate relative to said tubular housing portion between a first position in which said first and second openings communicate with one another to form a flow passage and a second position in which said first and second openings do not intercommunicate, said second opening being tapered in an annular direction of said hollow plug from one end of said second opening to another opposite end thereof so that the dimension of said flow passage is variable upon rotation of said hollow plug;

a sealing means provided around said hollow plug;

a spout connected to said front outlet end of said hollow plug;

a spout housing having a first enlarged front hollow portion which has a foremost second enlarged hollow portion broader than said first enlarged hollow portion, said first enlarged hollow portion having an outer periphery which is provided with a first screw thread, said second enlarged hollow portion having an inner periphery provided with a plurality of grooves, said spout further having a restricted rear hollow portion which is connected to said front outlet end of said hollow plug, said restricted hollow portion having a nozzle member extending therefrom into said first enlarged hollow portion, said nozzle member having a tube wall provided with a plurality of annularly spaced peripheral openings and a front outlet end, a hollow head movably provided in said first enlarged hollow portion, having an outer annular wall, an inner annular wall within said outer annular wall, a perforated cover plate which is connected to the front ends of said outer and inner annular wall and which has a central first opening and a plurality of second openings around said central opening, and a first annular flange which projects forwardly and flares outwardly from said front end of said outer annular wall and extends outwardly of said first enlarged hollow portion, said first annular flange having a plurality of third openings around said perforated cover plate, said first enlarged hollow portion, said perforated plate, said outer annular wall and said inner annular wall confining a pressure chamber anterior to said restricted hollow portion, said nozzle member extending into said inner annular wall passing through said pressure chamber, a first sealing ring provided between said inner annular wall and said nozzle member, a second sealing ring provided around said outer annular wall of said head, an adjustment ring member provided around said first enlarged hollow portion and having a second screw thread to engage with said first screw thread, said adjustment ring member being cooperatively associated with said first annular flange and capable of moving said head relative to said spout housing when said adjustment ring member is turned relative to said spout housing, the position of said second sealing ring being changeable between a first position, in which said second sealing ring is in an annular space between said second enlarged hollow portion and said outer annular wall, permitting a fluid flow between said annular space and said pressure chamber, and a second position, in which said second sealing ring is in between said first enlarged hollow portion and said outer annular wall, interrupting the communication between said annular space and said pressure chamber, the position of said inner annular wall relative to said nozzle member being changeable between a third position in which said first sealing ring of said inner annular wall is anterior to said peripheral openings of said nozzle member, sealing off the fluid communication between said peripheral openings and said inner annular wall and a fourth position in which said inner annular wall surrounds said peripheral openings.

2. A water jet gun as claimed in claim 1, wherein said second opening is triangular.

3. A water jet gun as claimed in claim 1, further including an annular guide member, around said head, which is engaged with said first annular flange of said head as well as connected threadedly to said adjustment member.

* * * * *